US005497175A

United States Patent [19]

Maeda

[11] Patent Number: 5,497,175

[45] Date of Patent: Mar. 5, 1996

[54] IMAGE FORMING APPARATUS HAVING APERTURE ELECTRODES WITH LUBRICATING LAYER THEREON

[75] Inventor: Masataka Maeda, Konan, Japan

[73] Assignee: Brother Kogyo Kabushiki Kaisha, Nagoya, Japan

[21] Appl. No.: 273,927

[22] Filed: Jul. 12, 1994

[30] Foreign Application Priority Data

Oct. 22, 1993 [JP] Japan ..... 5-264644

[51] Int. Cl.[6] ..... B41J 2/415

[52] U.S. Cl. ..... 347/55

[58] Field of Search ..... 347/55, 120, 123, 347/127; 355/200, 245

[56] References Cited

U.S. PATENT DOCUMENTS

| | | | |
|---|---|---|---|
| 3,689,935 | 9/1972 | Pressman et al. | 347/55 |
| 4,635,074 | 1/1987 | Young | 347/55 X |
| 5,036,341 | 7/1991 | Larsson | 347/55 |
| 5,153,611 | 10/1992 | Kokado et al. | 347/55 |
| 5,170,785 | 12/1992 | Takemura et al. | 347/55 |
| 5,200,769 | 4/1993 | Takemura et al. | 347/55 X |
| 5,404,155 | 4/1995 | Kitamura | 347/55 X |

*Primary Examiner*—Benjamin R. Fuller
*Assistant Examiner*—John E. Barlow, Jr.
*Attorney, Agent, or Firm*—Oliff & Berridge

[57] ABSTRACT

An image forming apparatus uses an electrode member with apertures therein through which toner is passed according to an image. The electrode member has a lubricant layer contacting the surface of a toner carrier. The lubricant layer is made of molybdenum disulfide. Friction between the surface of the lubricant layer directly contacting the toner carrier and the toner particles carried thereon is so small that the adhesion of the toner particles is negligibly disturbed. Therefore, the switching control voltage for forming the image can be small.

20 Claims, 4 Drawing Sheets

IMAGE FORMING APPARATUS HAVING APERTURE ELECTRODES WITH LUBRICATING LAYER THEREON

BACKGROUND OF THE INVENTION

1. Field of the Invention

The invention relates to an image forming apparatus with an electrode unit having a plurality of apertures for use in a copying machine, a printer, a plotter, a facsimile machine, or other apparatus that produces a printed product.

2. Description of the Related Art

Heretofore, there has conventionally proposed an image forming apparatus in which an image is formed by using a plurality of apertures. In this image forming apparatus, a voltage is selectively applied to the apertures in accordance with image data to control toner particles to selectively pass through the apertures. The toner particles which could pass through the apertures form an image on an image forming medium. This type of an image forming apparatus is disclosed in U.S. Pat. No. 3,689,935.

This image forming apparatus includes an aperture electrode having a plain plate made of an insulating material, a continuous reference electrode formed on a one side of the plain plate and a segmented control electrode formed on the other side of the plain plate. The electrodes of the segmented control electrode are insulated from each other. The aperture electrode is formed as at least one row of apertures through the three layers with an aperture through each electrode of the segmented control electrode. The image forming apparatus further comprises a power supply for supplying an electric potential selectively between the reference electrode and the electrodes of the segmented control electrode, a toner supplier for supplying toner particles so that the density of the particle stream is modulated according to the pattern of potentials applied to the electrodes of the segmented control electrode, and positioning means for positioning a print receiving medium in the particle stream by moving the print receiving medium and the aperture electrode relatively.

However, this conventional apparatus does not provide high speed printing and further reduces printing quality by blinding the apertures.

The applicant proposed an improved version of the image forming apparatus in patent application Ser. No. 08/112,471 filed on Aug. 27, 1993 by the same inventor. application Ser. No. 08/112,471 improves a printing characteristic by contacting an aperture electrode with a toner carry means having toner. In this apparatus, toner particles are supplied concurrently with the contacting toner around the apertures of the aperture electrode so that toner which can cause blinding of the apertures does not accumulate on the apertures. Consequently the apertures of the aperture electrode aren't blinded.

In application Ser. No. 08/112,471, a force is added to the toner on the toner carrier means by rubbing the toner on the toner carrier means with the aperture electrode. Consequently, the distribution and adhesion of the supplied toner on the toner carrier means is not uniform either to charge or thickness because of imperfections, however slight, in the toner carrier means. Therefore, the toner having a slight or lesser charge and the toner being fully charged are mixed and supplied concurrently. A switching potential difference, which is the difference between the control voltage at off time when all of the toner particles are retained on the toner carrier means and the control voltage at on time when the necessary toner particles flow to the print receiving medium, must increase to compensate for this inequality in charge. Consequently, expensive driving elements are required. Further, the toner given the unequal charges flows in greater amounts to the image forming part thereby producing an excessive or dirty image.

SUMMARY OF THE INVENTION

It is an object of the invention to overcome the above and other deficiencies and disadvantages of the related art and to provide an inexpensive image forming apparatus capable of forming high quality images using a cheap driving element by making the switching voltage deference small.

In carrying out the invention and according to one aspect thereof, there is provided an image forming apparatus comprising a toner supply that supplies charged toner particles, including a toner carrier member; an image support that supports an image formed of charged toner particles based on image data; and a toner flow control member disposed between the toner supply and the image support, the toner flow control member directly contacting the toner carrier member on one surface, the toner flow control member including a plurality of apertures surrounded by control electrodes that create an electric field to selectively draw charged toner particles through the apertures, wherein friction between the surface of the toner flow control member directly contacting the toner carrier member and toner particles is smaller than friction between the surface of the toner carrier member directly contacting the toner flow control member and toner particles.

In operation, a toner supply supplies charged toner particles to a toner flow control member. The toner flow control member is disposed between the toner supply and the support. The toner flow control member directly contacts the toner carrier member on one surface. The toner flow control member creates an electric field to selectively draw charged toner particles through the apertures. Since friction between the surface of the toner flow control member directly contacting the toner carrier member and the toner particles is smaller than friction between the surface of the toner carrier member directly contacting the toner flow control member and the toner particles, the toner particles are not adhered uniformly. Thus, the distribution of adhesion between toner particles and toner carrier member is varied and the control voltage of toner flow control member can be small.

BRIEF DESCRIPTION OF THE DRAWINGS

A preferred embodiment of the invention will be described in detail with reference to the figures, wherein:

FIG. 3(*b*) is a graph showing the relationship between the quantity of the flown toner and the control voltage;

FIG. 4(*b*) is a graph showing the relation of the quantity of the flown toner and the control voltage of the related art.

DETAILED DESCRIPTION OF PREFERRED EMBODIMENTS

Figure 1:
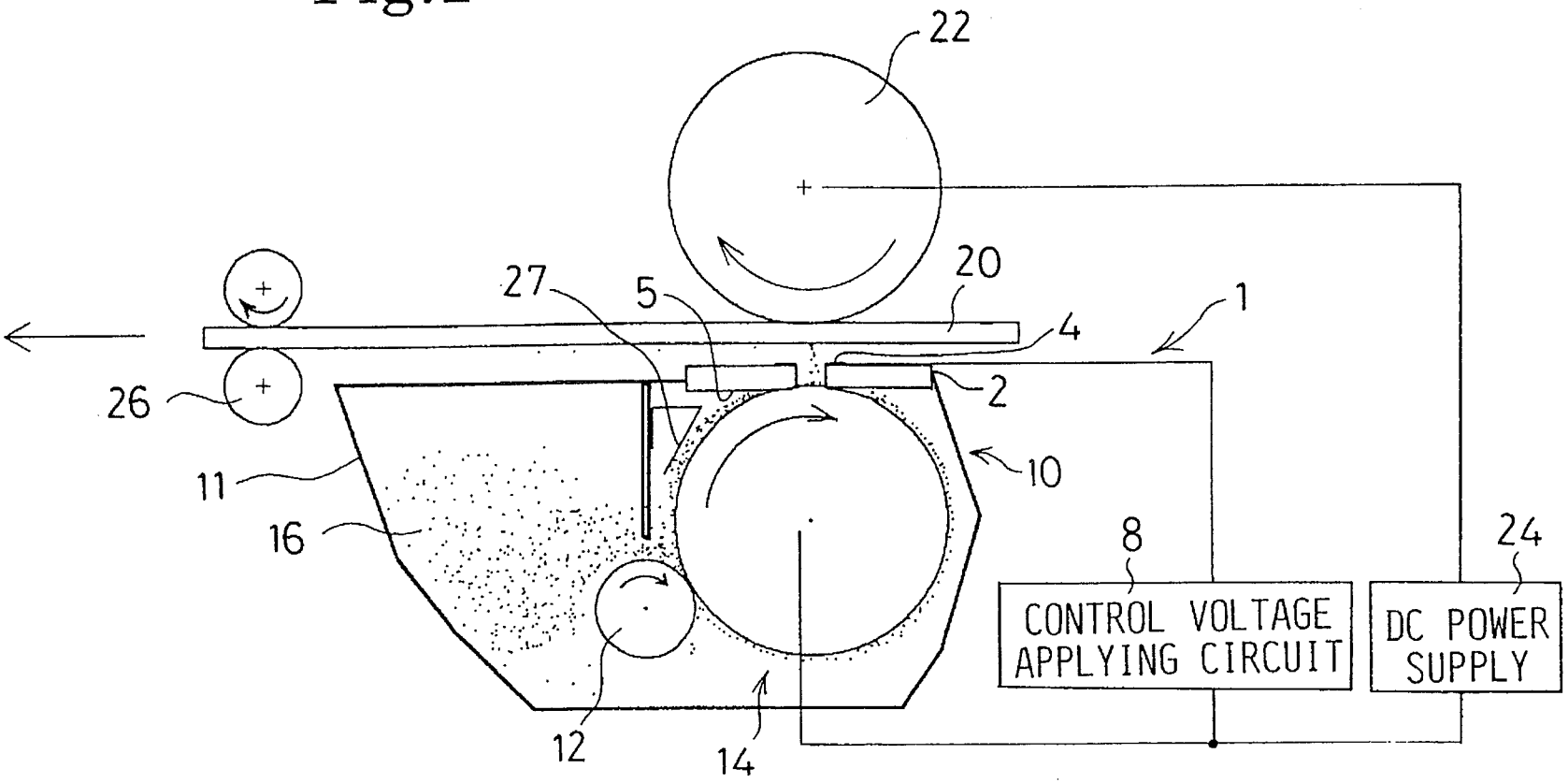
FIG. 1 is a schematic side view in partial section of the image forming apparatus of the preferred embodiment.

Hereafter, a preferred embodiment of the invention will be described with reference to the accompanying drawings. FIG. 1 shows sectional view of the preferred embodiment. A back electrode roller 22 of a cylindrical shape is arranged pivotally on a chassis (not shown) with approximately a one millimeter space between the back electrode roller 22 and an upper surface of the aperture electrode member 1. The aperture electrode member 1 includes an insulative sheet 2, preferably a polyimide film. An image supporting medium 20 is inserted in the one millimeter space and transported therethrough. A toner particle supply device 10 is positioned on the opposite side of the aperture electrode member 1 from the back electrode roller 22 and parallels the longitudinal axis of the electrode member 1. In addition, a fixing device 26 is arranged on the transporting path of the image supporting medium 20 for fixing the image transferred by the back electrode roller 22.

The toner particle supply device 10 comprises a toner particle casing 11, a supplying roller 12, a toner particle carrying roller 14, and a toner particle layer trimming blade 27. The toner particle carrying roller 14 supports toner particles 16 and transfers the toner particles 17 toward the aperture electrode member 1. The supplying roller 12 supplies the toner particles 16 to the toner particles carrying roller 14. The supplying roller 12 and the toner particles carrying roller 14 are supported by the toner particle casing 11. The rollers 12,14 are rotatable in the direction of the arrows shown in FIG. 1. The rollers 12,14 are arranged in parallel and contact each other.

The toner particle layer trimming blade 27 contacts the toner particles carrying roller 14 under pressure. The toner particle layer trimming blade 27 adjusts the amount of toner particles 16 carried on the toner particles carrying roller 14 so that the amount is kept uniform on the toner particles carrying roller 14 and the toner particle layer trimming blade 27 further uniformity charges the toner particles 16.

Figure 2:
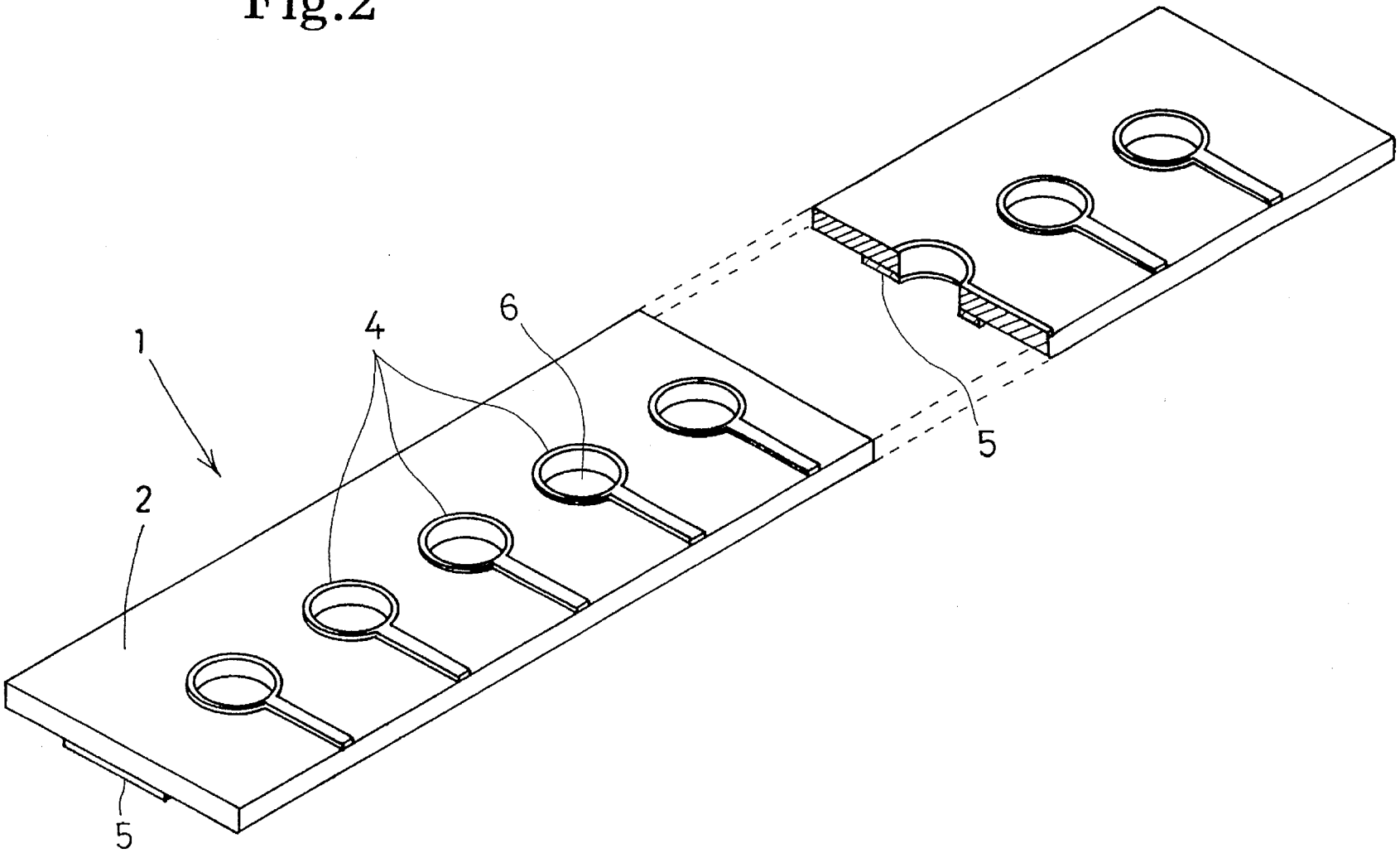
FIG. 2 is a perspective view in partial section showing the construction of an aperture electrode of the preferred embodiment.

A row of apertures 6 is formed in the polyimide insulative sheet 2 of the aperture electrode member 1 as shown in FIG. 2. The diameter of each aperture 6 is preferably approximately 100 μm, and the insulative sheet preferably has a thickness of approximately 25 μm. Control electrodes 4 of preferably approximately 1 μm thickness are formed around the apertures 6 on the insulative sheet 2. A lubricating layer 5 of 5 μm thickness is formed at least at the surface contacting the toner particles 16 carried on the toner particle carrying roller 14, namely on the opposite side to the side of the control electrodes 4 as formed on the insulative sheet 2.

The lubricating layer 5 is a coat in which disulfide molybdenum is dispersed in a binder. The binder comprises a polyimide resin, such as an epoxy resin or an organic resin, or preferably polyimide resin and conditioned coating material. After applying to the insulating sheet 2, the coat is baked for 2 to 7 minutes under normal atmospheric conditions and at a temperature of less than 230° C., preferably between 150° C. and 180° C., and cured.

The aperture electrode member 1 is arranged so that the control electrodes 4 face the image supporting medium 20 and the lubricating layer 5 of the insulative sheet 2 contacts the toner particles 16 carried on the toner particles carrying roller 14 when in its operative position.

A control voltage applying circuit 8 is connected between the control electrodes 4 and the toner particles carrying roller 14. The control voltage applying circuit 8 applies a voltage +40 volts or +70 volts to the control electrodes 4 based on the image signal. Moreover, a DC power supply 24 is connected between the back electrode roller 22 and the toner particle carrying roller 14. The DC power supply 24 applies a voltage of +1 k volts to the back electrode roller 22.

In operation, the toner particles 16 are moved from the supplying roller 12 by rotation of the toner particles carrying roller 14 and the supplying roller 12 in the direction of the arrows shown in FIG. 1. When the toner particles 16 are rubbed with the toner particles carrying roller 14, the toner particles 16 are negatively charged and supported on the toner particles carrying roller 14. After the supported, charged toner particles 16 are formed by the thin layer trimming blade 27, the charged toner particles 16 are transferred toward the aperture electrode member 1 by the rotation of the toner particles carrying roller 14. The toner particles 16 supported on the toner particles carrying roller 14 are supplied under the apertures 6 where rubbing against the lubricating layer 5 of the aperture electrode member 1 occurs.

The voltage of +70 volts is applied from the control voltage applying circuit 8 to the control electrodes 4 which correspond to the image portion according to the image signal. As a result, an electric force line to the toner particles carrying roller 14 from the control electrodes 4 is formed adjacent to the apertures 6, corresponding to the image portion, by the potential difference between the control electrodes 4 and the toner particles carrying roller 14. Accordingly, the negatively charged toner particles pass through the apertures 6 from the toner particles carrying roller 14 to the control electrode 4 side. The toner particles 16 drawn to the control electrode 4 side are attracted toward the image supporting medium 20 by the electric field formed between the image supporting medium 20 and the aperture electrode member 1 by the voltage applied to the back electrode 22. The toner particles 16 accumulate on the image supporting medium 20 to form a pixel.

To the control electrodes 4 corresponding to a non-image area, the voltage of +40 volts is applied from the control voltage applying circuit 8. Accordingly an electric line to the toner particles roller 14 from the control electrodes 4 is formed. Since the driving force of this electric force line is smaller than the adhesion force between the toner particles and the toner particles carrying roller 14, toner particles 16 remain on the toner particles carrying roller 14 do not pass through the apertures 6.

When a row of pixels is formed on the image supporting medium 20 with toner particles 16, the image supporting medium 20 is fed one pixel row at a time in the direction perpendicular to the row of the apertures to form the toner particle image over the image supporting medium 20 by repeating the above mentioned process. Afterwards, the formed toner particle image is fixed on the image supporting medium 20 by the fixing device 26.

Figure 3A:
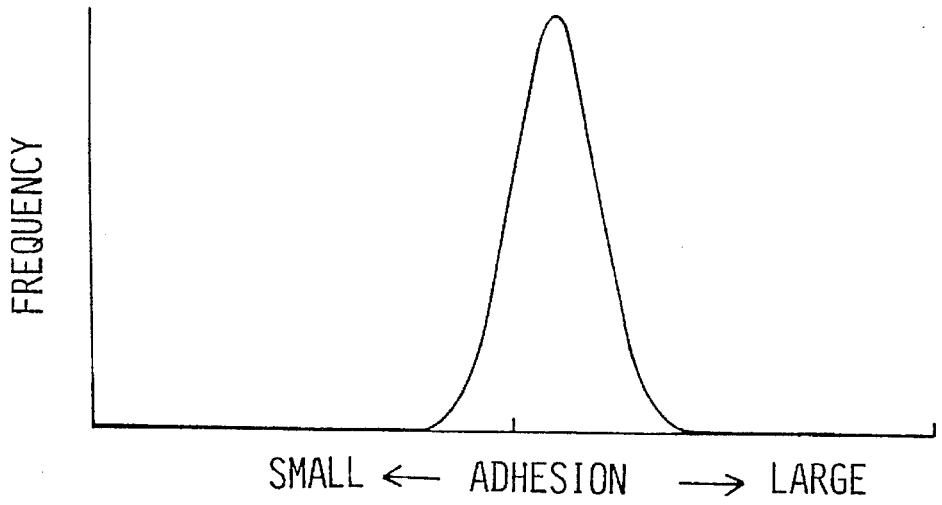
FIG. 3(*a*) is a graph showing adhesion distribution of toner on a toner carrier roller.
Figure 3B:
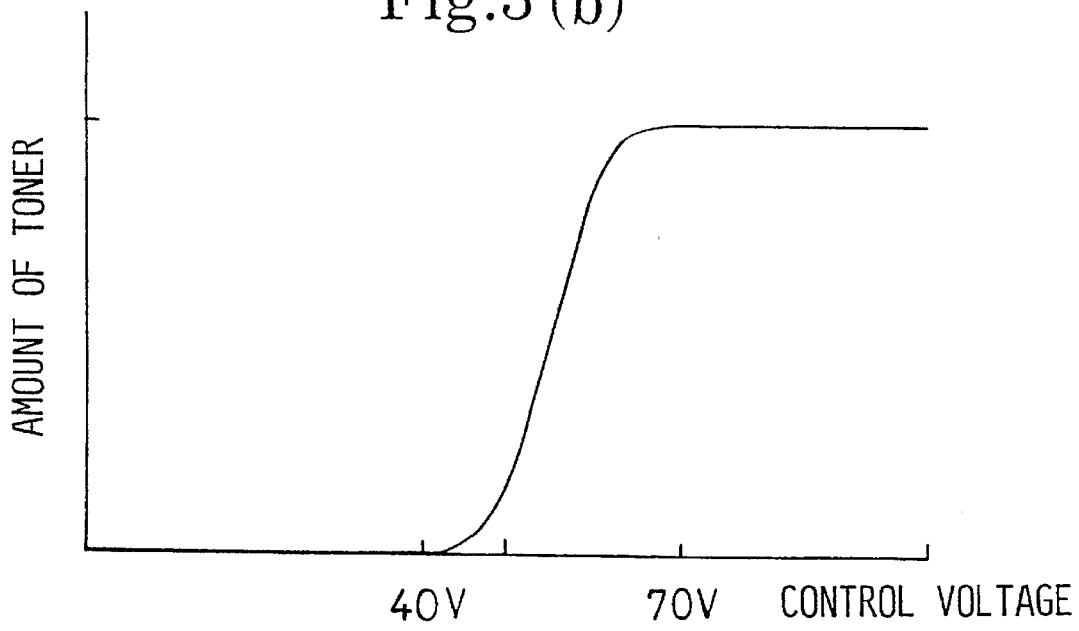
Figure 4:
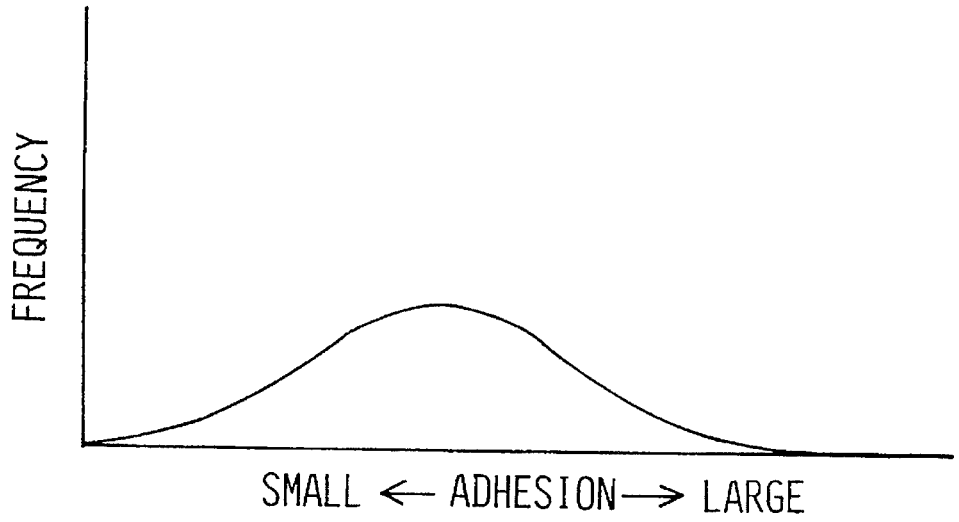
FIG. 4(*a*) is a graph showing adhesion distribution of toner on a toner carrier roller of the related art.
Figure 4:
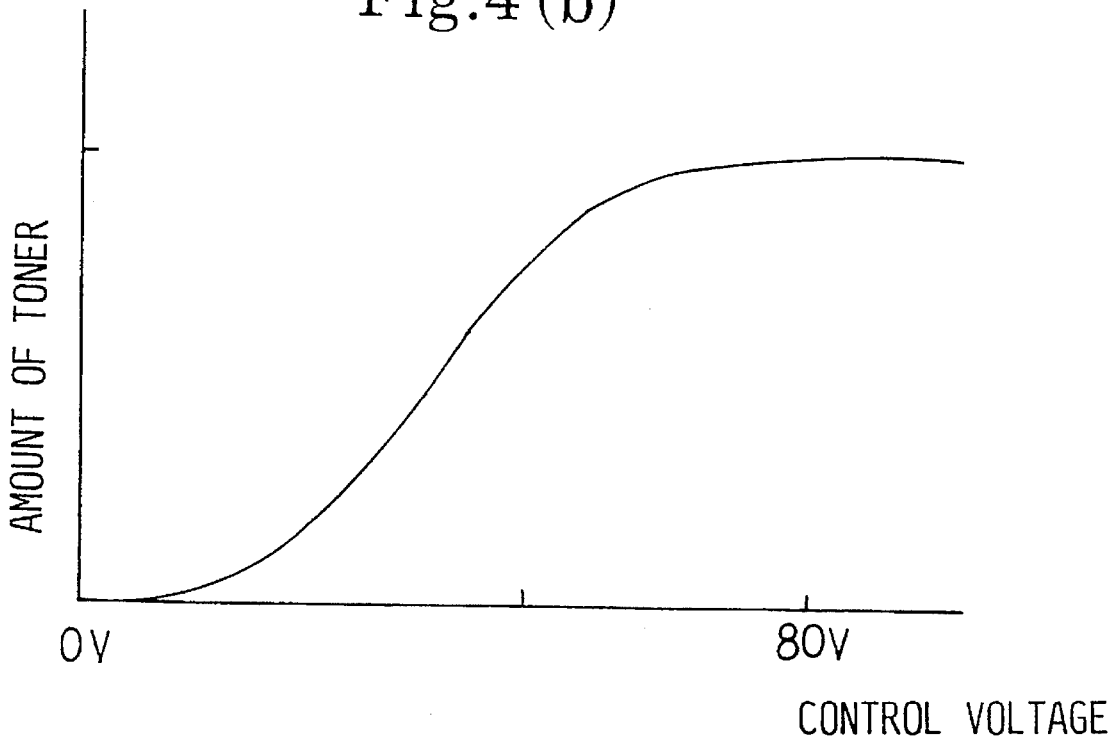

When toner particles 16 are carried on the toner particles carrying roller 14 but before toner particles are rubbed with the aperture electrode member 1, the adhesion between the toner particles 16 and the toner particles carrying roller 14 has a distribution with small dispersion as shown in FIG. 3(*a*). The adhesion force between the toner particles 16 and the toner particles carrying roller 14 when the conventional aperture electrode member, without the lubricating layer 5, contacts the toner particles 16 has a distribution with large dispersion, shown in the FIG. 4(*a*), since the toner particles are broken loose by rubbing with the conventional aperture electrode member without the lubricating layer 5. As the control voltage increases gradually, the driving force of the toner flow is increased. When the driving force exceeds the adhesion force, the toner particles 16 pass through the apertures. The relationship of the amount of the toner particles 16 passing through the apertures and control voltage is gentle gradient as shown FIG. 4(*b*). Thus, in the related art, a control voltage of less than 0 volt at the non-image forming area and of more than 80 volts is required at the image forming area. Thus, a driving element having a voltage output of at least 80 volts is required.

In the apparatus of the invention, which supplies toner particles to adjacent the apertures 6 using the electric apertures element 1 having the lubrication layer 5, when toner particles 16 on the toner particles carrying roller 14 rub with the lubricant layer 5 of the aperture electrode element 1, friction forces between the toner particles and the lubricant layer 5 are small. The adhesion forces of the toner particles supplied to the lower part of the electric apertures element 1 is almost as same as the adhesion force before rubbing. Consequently, the relation between the control voltage and the amount of toner particles passing through the apertures is a radical gradient as shown in FIG. 3(*b*). Thus, it is possible to control the toner flow by using a control voltage of +40 volts at the non-image forming area and a voltage of +70 volts at the image forming area. Therefore, the driving element is required to switch the voltage over a difference of only 30 volts and that is enough for printing the image. Therefore, an inexpensive printing apparatus can be provided according to the invention.

It is to be understood that the invention is not restricted to the particular forms shown in the foregoing embodiment. Various modifications and alternations can be made thereto without departing from the scope of the invention encompassed by the appended claims.

For example, while according to the above mentioned embodiment disulfide molybdenum is used in the lubricating layer 5 as the lubricant, other solid lubricants, such as graphite, boron nitride, fluorine resin such as PTFE, and PbO may be used. Also, while the aperture electrode member is used as the electric field control means in the above mentioned embodiment, a mesh electrode member as disclosed in U.S. Pat. No. 5,036,341 can be used.

According to this embodiment, an inexpensive image forming apparatus capable of forming high quality images using a low cost driving element is provided.

What is claimed is:

1. A image forming apparatus, comprising:

a toner carrier having charged toner particles for supplying the charged toner particles;

a toner flow control member having openings therein with control electrodes formed around said openings, said toner flow control member controlling a flow of the charged toner particles from said toner carrier through said openings with an electric field, and said toner flow control member having a lubricant layer disposed on a surface directly contacting said toner carrier; and a back electrode confronting said toner flow control member and attracting charged toner particles that have passed through said openings, wherein said back electrode and said toner flow control member are positioned to sandwich an image receiving medium therebetween.

2. A image forming apparatus as claimed in claim 1, wherein said lubricant layer is made of molybdenum disulfide.

3. A image forming apparatus as claimed in claim 1, wherein said lubricant layer comprises graphite, baron nitride, fluorine resin or PbO.

4. A image forming apparatus as claimed in claim 1, wherein said toner carrier is a roller and said lubricant layer is disposed on the surface facing the roller at least on a side of the openings first encounted by rotation of the roller.

5. A image forming apparatus as claimed in claim 1, wherein said toner carrier is a roller and said lubricant layer is disposed on the surface of said toner flow control member around the openings.

6. A image forming apparatus as claimed in claim 1, wherein said toner carrier further comprises a toner particle casing that stores toner particles, a toner carrier roller within said toner particles casing that receives toner particles from said toner particle casing and transports the toner particles to said toner flow control member and a toner trimming blade disposed to contact the toner particles carried by said toner carrier roller.

7. A image forming apparatus as claimed in claim 1, further comprising a voltage supply coupled to said control electrodes to selectively supply a voltage to each of said control electrodes and a power supply coupled to said back electrode to supply a voltage to said back electrode.

8. A image forming apparatus, comprising:

a toner supply that supplies charged toner particles and includes a toner carrier member;

an image support that supports an image formed of charged toner particles based on image data; and a toner flow control member disposed between said toner supply and said image support, said toner flow control member having a surface directly contacting a surface of said toner carrier member, said toner flow control member including a plurality of apertures surrounded by control electrodes that create an electric field to selectively draw charged toner particles through said apertures, wherein a friction force between the surface of said toner flow control member directly contacting said toner carrier member and the toner particles is smaller than a friction force between the surface of said toner carrier member directly contacting said toner flow control member and the toner particles.

9. A image forming apparatus as claimed in claim 8, wherein said toner flow control member has a lubricant layer disposed on the surface directly facing said toner carrier member.

10. A image forming apparatus as claimed in claim 9, wherein said lubricant layer is made of molybdenum disulfide.

11. A image forming apparatus as claimed in claim 9, wherein said lubricant layer comprises graphite, baron nitride, fluorine resin or PbO.

12. A image forming apparatus as claimed in claim 9, wherein said toner carrier member is a roller and said lubricant layer is disposed on the surface facing the roller on a side of the apertures first encountered by rotation of the roller.

13. A image forming apparatus as claimed in claim 9, wherein said toner carrier member is a roller and said lubricant layer is disposed on the surface of said toner flow control member around the apertures.

14. A image forming apparatus as claimed in claim 8, wherein said toner carrier further comprises:

a toner particle casing that stores toner particles;

a toner carrier roller within said toner particles casing that receives toner particles from said toner particle casing and transports the toner particles to said toner flow control member; and a toner trimming blade disposed to contact the toner particles carried by said toner carrier roller.

15. A image forming apparatus as claimed in claim 8, further comprising a voltage supply coupled to said control electrodes to selectively supply a voltage to each of said control electrodes and a power supply coupled to said back electrode to supply a voltage to said back electrode.

16. A image forming apparatus, comprising:

toner charging means for charging toner particles;

toner carrier means for carrying the charged toner particles charged by said toner charging means;

toner flow control means having openings therein and control electrodes formed around said openings, said toner flow control means for controlling a flow of the charged toner particles from said toner carrier means through said opening using an electric field, and said toner flow control means having a lubricant means disposed on a surface directly contacting said toner carrier means;

image support means for supporting image data formed of charged toner particles based on the image data; and back electrode means confronting said toner flow control member, said back electrode means for attracting charged toner particles that have passed through said openings, wherein said back electrode and said toner flow control member are positioned to sandwich an image support means therebetween.

17. A image forming apparatus as claimed in claim 16, wherein said lubricant means is made of molybdenum disulfide.

18. A image forming apparatus as claimed in claim 16, wherein said lubricant means is made of a material selected from the group consisting of graphite, baron nitride, fluorine resin and PbO.

19. A image forming apparatus as claimed in claim 16, wherein said toner carrier means is a roller and said lubricant means is disposed on the surface facing the roller on a side of the openings first encountered by rotation of the roller.

20. A image forming apparatus as claimed in claim 16, wherein said toner carrier means is roller, and said lubricant means is disposed on the surface of said toner flow control means around the openings.

* * * * *